United States Patent [19]

Siwy

[11] Patent Number: 4,486,057

[45] Date of Patent: Dec. 4, 1984

[54] HASP CONSTRUCTION

[76] Inventor: Charles C. Siwy, 248 Elmsford Dr., W. Seneca, N.Y. 14224

[21] Appl. No.: 447,781

[22] Filed: Dec. 8, 1982

[51] Int. Cl.[3] ..... E05B 65/44; E05B 65/48

[52] U.S. Cl. ..... 312/216; 292/281; 312/222; 312/333

[58] Field of Search ..... 70/2, 6, 13, 63; 49/394, 449; 292/281–286; 312/107.5, 216, 222, 333; 16/223

[56] References Cited

U.S. PATENT DOCUMENTS

| | | | |
|---|---|---|---|
| 1,371,087 | 3/1921 | Haslett | 16/223 X |
| 1,377,426 | 5/1921 | Olson . | |
| 1,389,450 | 8/1921 | Kules . | |
| 1,437,204 | 11/1922 | Seger . | |
| 2,428,207 | 9/1947 | Dzurinda | 292/340 |
| 2,790,664 | 4/1957 | Bramley et al. | 292/285 |
| 2,913,296 | 11/1959 | Martin | 312/216 |
| 3,805,325 | 4/1974 | Lee | 16/223 X |
| 3,893,740 | 7/1975 | England | 312/216 |

*Primary Examiner*—William E. Lyddane
*Assistant Examiner*—Joseph Falk
*Attorney, Agent, or Firm*—Bean, Kauffman & Bean

[57] ABSTRACT

An improved hasp construction is disclosed for use in releasably securing a pair of adjacently disposed closures in a closed condition relative to a closure bounding frame; the hasp including a first plate secured to one of the closures and a second plate hingedly mounted on the first plate for movement between an operative position in which it overlies the second closure and cooperates with a frame mounted staple to releasably secure both of the closures in their closed condition and inoperative position in which it is removed from cooperative association with the staple and arranged to overlie the first closure to permit selective opening movements of the closures relative to one another and the frame.

5 Claims, 4 Drawing Figures

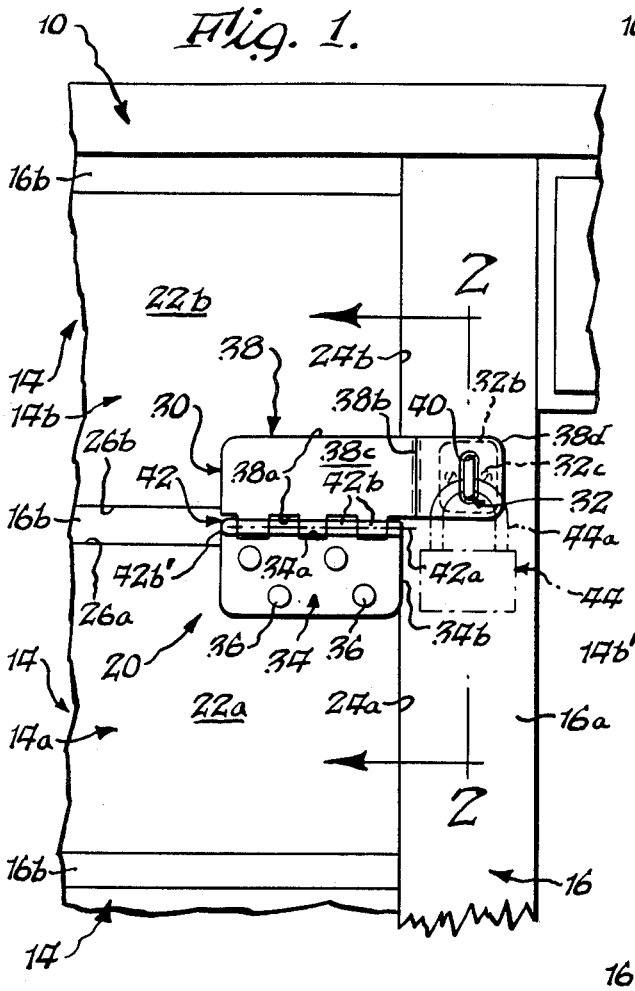
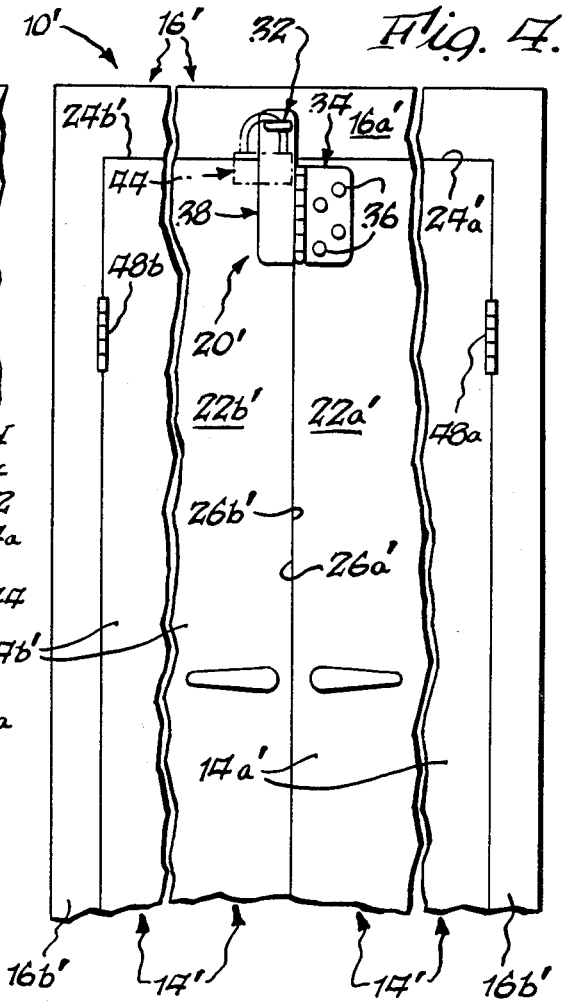
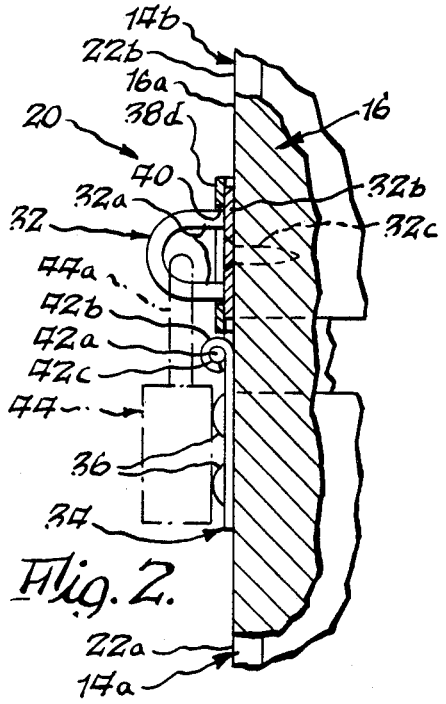
Fig. 2.
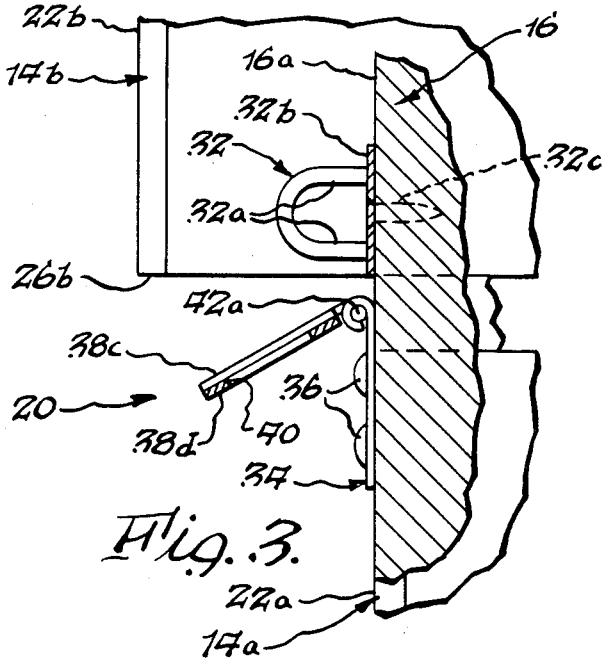
Fig. 3.

HASP CONSTRUCTION

BACKGROUND OF THE INVENTION

Various means have been proposed to increase the security of closures, such as cabinet drawers and doors, against unauthorized opening movements, and/or to give clear visual indication of the occurrence of any such unauthorized movement.

In typical cabinets, such as may be defined by the desk pedestal or a separate filing cabinet employing closures in the form of sliding drawers and by storage cabinets employing closures in the form of swinging doors, it is conventional practice to provide the cabinet or its individual closures with built-in, key operated locks for security purposes. Drawbacks of typical cabinets involve the ease with which its key operated lock(s) may be tampered with in the absence of later observable signs of unauthorized entry and/or the difficulty with which persons, such as security personnel, may determine the locked/unlocked condition of the cabinet closures without manual inspection/manipulation. To overcome these drawbacks, it has long been the practice, when maximum security is required, to retrofit commercially available cabinets with security bars, which are sized to bridge across the cabinet closures and have their opposite ends secured to closure bounding portions of the cabinet frame by means of one or more padlocks, whose locked/unlocked condition is visually discernible without resort to manual inspection. For cases wherein less than all of the closures of any given cabinet are required to be afforded extra security, it has been normal practice to fit each closure to be afforded extra security, with a conventional hasp intended to be releasably secured to an associated frame mounted staple by means of a padlock; such hasps typically being similar in construction and mode of operation to hasps conventionally employed to secure diverse types of single swinging doors in closed condition relative to their associated door frames.

SUMMARY OF THE INVENTION

The present invention is directed to security devices and more particularly to an improved hasp construction for use in releasably securing a pair of adjacently disposed closures in a closed condition relative to a closure bounding, cabinet frame; the present hasp being equally adapted for use with closures in the form of sliding drawers or in the form of swinging doors.

The present hasp has for instance, utility in cabinets having extra security requirements for only two adjacent drawers of a three or more drawer cabinet installation, such as the bottom or top two drawers provided in a standard three drawer desk pedestal. The advantage stemming from the use of the present hasp construction, as opposed to hasps of prior practice, is that one hasp and one padlock serves to replace two conventional hasps and two padlocks previously required. Moreover, the time required for authorized personnel to properly secure the drawers in closed condition and unlock same is reduced essentially by one half.

More specifically, the present hasp includes a first plate secured to one of the closures and a second plate hingedly mounted on the first plate for movement between an operative position in which it overlies the second closure and cooperates with a frame mounted staple to releasably secure both of the closures in their closed conditions and inoperative position in which it is removed from cooperative association with the staple and arranged to overlie the first closure to permit selective opening movements of the closures relative to one another and the frame.

DRAWINGS

The nature and mode of operation of the present invention will now be more fully described in the following detailed description taken with the accompanying drawings wherein:

FIG. 1 is a fragmentary front elevational view of a desk pedestal cabinet having a pair of adjacent sliding drawers releasably secured in closed condition by the security device of the present invention;

FIG. 2 is a sectional view taken generally along the line 2—2 in FIG. 1;

FIG. 3 is a view similar to FIG. 2, but showing the hasp in inoperative condition; and FIG. 4 is a fragmentary front elevational view of a cabinet having a pair of adjacent swinging doors releasably secured in closed condition by the security device of the present invention.

DETAILED DESCRIPTION

Reference is first made to FIG. 1, wherein a cabinet is generally designated as 10 and shown for example as being defined by a desk pedestal having a plurality of closures in the form of drawers 14 slidably supported by a drawer bounding cabinet frame 16 for independent movement between closed and open conditions. The construction and design of cabinet 10 may be conventional in all respects and thus forms no part of the present invention other than as same is employed in combination with the security device of the present invention, which is generally designated as 20 in FIGS. 1–3. However, to facilitate description of the present invention, including an understanding of the mode of operation thereof, cabinet 10 will be described in part as including at least two adjacently disposed drawers, including a first drawer **14*a* and a second drawer 14*b* forming for example, the upper two drawers of a desk pedestal, wherein such drawers include front surfaces 22*a* and 22*b*; end edges 24*a* and 24*b*; and parallel side edges 26*a* and 26*b*. End edges 24*a* and 24*b* are disposed in essential alignment and side edges 26*a* and 26*b* are disposed relatively adjacent one another when drawers 14*a* and 14*b* are disposed in their closed positions shown in FIGS. 1 and 2. Further, in the illustrated cabinet construction, frame 16 is shown in part as including a frame member 16*a* extending along drawer end edges 24*a* and 24*b* and transverse frame members 16*b* extending lengthwise of drawer side edges 26*a* and 26*b***.

Reference is now made to FIGS. 1–3, wherein security device 20 is shown as generally including a hasp 30 formed in accordance with a preferred form of the present invention and means, such as a staple 32, arranged to cooperate with hasp 22 for purposes of releasably securing drawers **14*a* and 14*b* in closed condition relative to frame 16. Hasp 22 includes a rigid, one piece first plate 34, which is suitably fixed to lie in engagement with front surface 22*a* of first drawer 14*a*, such as by means of bolt fasteners 36 extending through plate apertures, not shown; a rigid, one piece second plate 38 having an elongated slot 40; and hinge means 42 for joining one of the side edges 38*a* of second plate 38 to an adjacent side edge 34*a* of first plate 34 for swinging movement about a hinge axis 42*a* between an operative position shown in FIGS. 1 and 2, and an inoperative position shown in FIG. 3**.

In a typical installation illustrated by way of example in FIG. 1, first plate 34 is fixed adjacent an upper right hand corner of front surface 22*a* with its side edge 34*a* and one of its end edges 34*b* arranged essentially parallel to drawer side edge 26*a* and end edge 24*a*, respectively. The exact positioning of first plate 34 relative to side edge 26*a* of first drawer 14*a* is not critical, so long as the transverse dimension of second plate 38, as measured between its side edges 38*a* is sufficient to permit the second plate, when in its operative position to bridge across drawer side edge 26*b* and lie in a position for abutting engagement with front surface 22*b* of second closure 14*b*, as shown in FIGS. 1 and 2, while at the same time permitting the second plate, when swung into its inoperative position, to be removed from such position, as shown in FIG. 3 in order to free second drawer 14*b* for unobstructed opening movements relative to both first drawer 14*a* and frame 16. Again, the exact positioning of first plate 34 relative to end edge 24*a* of first drawer 14*a* is not critical, so long as the lengthwise dimension of second plate 38, as measured lengthwise of hinge means 42 is sufficient to permit the second plate, when in its operative position, to bridge across drawer end edge 24*b* for cooperation with staple 32 for purposes of securing drawers 14*a* and 14*b* in their closed positions. Preferably, plates 34 and 38 are in the form of generally rectangular metal plates, wherein second plate 38 has a length exceeding that of plate 34, such that a portion thereof containing slot 40 is arranged for overlying engagement with frame member 16*a*, when first plate end edge 34*b* is disposed in alignment with first drawer end edge 24*a*.

The construction of staple 32 and the mode of attaching same to frame member 16*a* may be conventional and thus forms no part of the present invention. However, for purposes of illustration, staple 32 is shown as being of a typical U-shaped configuration and as having its leg portions 32*a* suitably fixed to upstand from a mounting plate 32*b*, which may in turn be suitably fixed to frame member 16*a*, such as by threaded fasteners or bolts 32*c*. When staple 32 utilizes a mounting plate, as opposed to having the ends of its leg portions connected directly to frame member 16*a*, it would be desirable to bend second plate 38 in the area designated as 38*b* in FIG. 1 to provide a main plate portion 38*c* and an offset, parallel extension or locking portion 38*d* adapted to be disposed in simultaneous engagement with drawer front surface 22*b* and the outer surface of mounting plate 32*b*, respectively.

The size of staple 32 is not critical, so long as same is sufficient to receive the shackle 44*a* of a conventional key or combination style padlock 44 for purposes of releasably retaining the staple seated within slot 40. In like manner, the size of slot 40 is not critical, so long as same is sufficient to removably receive staple 32, as second plate 38 is pivoted between its operative and inoperative positions shown in FIGS. 2 and 3, respectively. However, it is desirable that slot 40 and staple 32 be arranged such that same are lengthwise bisected by a plane, not shown, arranged normal to hinge axis 42*a*.

Hinge means 42 may be of any desired construction, so long as it serves to prevent unauthorized separation of plates 34 and 38. However, hinge means 42 is shown as comprising a plurality of interfitting hinge curls 42*b* formed integrally with side edges 34*a* and 38*a* of plates 34 and 38, respectively; and a hinge pin 44*c*, which freely extends through the curls, but is permanently secured therewithin by suitable means, such as by welding same to an endmost curl 42*b*'.

From the foregoing, it will be understood that, when second plate 38 is in its operative position with staple 32 received within slot 40 and shackle 44*a* in turn received within the staple, second plate 38 is retained in position for engagement with surface 22*b* of second drawer 14*b*, thereby preventing opening movements thereof; retention of the second plate in this manner additionally serving to prevent opening movements of first drawer 14*a*, due to the hinge connection between the second plate and first plate 34. When it is desired to open drawers 14*a* and/or 14*b*, padlock 44 would be unlocked and shackle 44 removed from within staple 32 to free second plate 38 for pivotal movement into an inoperative position, such as the position shown in FIG. 3, wherein the second plate will not obstruct opening movements of second drawer 14*b* and/or interfere with independent opening movements of first drawer 14*a*.

Reference is now made to FIG. 4, wherein security device 20 is shown as being identical in construction and mode of operation to that described with reference to FIGS. 1–3, but employed in association with a cabinet 10' of the type having a pair of adjacently disposed closures 14' in the form of doors 14*a*' and 14*b*', which are supported on a cabinet frame 16' by hinge means 48*a* and 48*b* for oppositely directed swinging movements from their illustrated closed positions about hinge axes arranged parallel to the axis of hinge means 42. For purposes of reference, portions of doors 14*a*' and 14*b*' and frame 16', which correspond to drawers 14*a* and 14*b* and frame 16 are designated by like primed numerals.

Although the security device of the present invention has been described with reference to its use with only two types of cabinets, it will be understood that its use is not so limited. Further, it will be understood that, while the preferred form of the invention employs a conventional staple positioned for receipt within a through slot defined by the second or hinged plate of the present hasp, the invention is not limited thereto. Rather, it is contemplated that any suitable means may be employed to releasably lock the second plate to a cabinet frame, so long as same is properly positioned on the frame for cooperation with such second plate when disposed in its operative position.

What is claimed is:

1. A hasp for use in combination with a staple for releasably retaining first and second adjacently disposed closures in closed condition relative to a frame extending along end edges of said closures disposed in an aligned condition when said closures are in said closed condition, wherein said closures additionally have parallel side edges disposed relatively adjacent one another when said closures are in said closed condition and said staple is mounted on said frame adjacent said end edge of said second closure, said hasp comprising:

a rigid one piece first plate having in part a side edge and an end edge adjoining said side edge thereof, said first plate is sized to permit same to be fixed to an outer surface of said first closure to arrange said side and end edges thereof adjacent said side and end edges of said first closure, respectively;

a rigid one piece second plate having in part oppositely disposed side edges; and hinge means for joining one of said side edges of said second plate to said side edge of said first plate to permit swinging movement of said second plate between an operative position, wherein it lies essentially coplanar with said first plate, and an inoperative position, wherein it overlies said first plate, said second plate having a transverse dimension extending between said side edges thereof sufficient to permit said second plate when in said operative position, to bridge across said side edge of said second closure and lie in surface abutting engagement with a front surface of said second closure, and said second plate is formed with a through slot extending normal to the axis of said hinge means and arranged to removably receive said staple when said second plate is in said operative position thereof.

2. In the combination of a cabinet having at least two adjacently disposed closures supported by a cabinet frame for movement between closed and open positions, and security means for releasably locking said closures to said frame for preventing movement of said closures from said closed positions thereof, the improvement comprising:

said security means includes a rigid first plate fixed to a front surface of a first of said closures;

a rigid second plate;

hinge means for joining said second plate to said first plate for swinging movement about a hinge axis between an operative position, wherein said second plate is disposed essentially coplanar with said first plate and in a position for overlying engagement with a front surface of a second of said closures, and an inoperative position, wherein said second plate is removed from said position for overlying engagement with said front surface of said second of said closures to permit selective opening movements of said closures relative to one another and said frame, said second plate has a locking portion arranged to overlie said frame adjacent said second of said closures when said second plate is in said operative position; and means fixed to said frame and positioned for cooperation with said locking portion of said second plate for securing said closures in said closed positions thereof, when said second plate is in said operative position.

3. The improvement according to claim 2, wherein the last said means is a staple of U-shaped configuration having legs thereof fixed to said frame, said locking portion of said second plate projects beyond said first plate in a direction extending lengthwise of said hinge axis and is formed with a through slot sized to releasably receive said staple, and said slot and said staple are lengthwise bisected by a plane arranged normal to said hinge axis.

4. The improvement according to claim 3, wherein said closures are drawers slidably supported by said frame for movement between said closed and open positions.

5. The improvement according to claim 3, wherein said closures are doors supported by said frame for swinging movements between said opened and closed positions about axes arranged parallel to said hinge axis.

* * * * *